US006035176A

United States Patent [19]

Byeon

[11] Patent Number: 6,035,176

[45] Date of Patent: Mar. 7, 2000

[54] IMAGE FORMING APPARATUS WITH CASSETTE-TYPE CLEANER

[75] Inventor: Sang-hyeon Byeon, Yongin, Rep. of Korea

[73] Assignee: Samsung Electronics Co., Ltd., Kyungki-Do, Rep. of Korea

[21] Appl. No.: 09/113,561

[22] Filed: Jul. 10, 1998

[30] Foreign Application Priority Data

Jul. 10, 1997 [KR] Rep. of Korea ..... 97-18236

[51] Int. Cl.[7] ..... G03G 21/00

[52] U.S. Cl. ..... 399/345; 15/1.51

[58] Field of Search ..... 15/1.51, 104.001, 15/104.002; 347/171; 399/123, 345, 346, 352

[56] References Cited

U.S. PATENT DOCUMENTS

| | | | |
|---|---|---|---|
| 3,659,302 | 5/1972 | Egnaczak | 15/1.51 |
| 4,862,221 | 8/1989 | Tabuchi et al. | 399/352 |
| 5,210,582 | 5/1993 | Lundy et al. | 399/349 |

*Primary Examiner*—Matthew S. Smith
*Assistant Examiner*—Hoang Ngo
*Attorney, Agent, or Firm*—Sughrue, Mion, Zinn, Macpeak & Seas, PLLC

[57] ABSTRACT

An image forming apparatus having a cassette-type cleaner for removing contaminants sticking to the surface of a photosensitive medium or a transfer roller including a photoreceptor belt circulating along an endless track by a plurality of rollers, a laser scanning unit for forming a latent electrostatic image on the photoreceptor belt, a development unit for developing the latent electrostatic image formed on the photoreceptor belt into a toner image; a drying unit for drying the photoreceptor belt; a transfer unit for transferring the toner image of the photoreceptor belt onto a sheet of paper, and a cassette-type cleaner having a case having a cavity at its one side, a cleaning belt partially exposed by the cavity and installed within the case so as to contact the contaminated portion of the image forming apparatus, and first and second guiding rollers rotatably installed within the case and spaced a predetermined distance spaced apart, for guiding the cleaning belt. The efficiency of removing contaminants sticking to the surface of the photoreceptor belt is increased by using the cassette-type cleaner.

5 Claims, 4 Drawing Sheets

IMAGE FORMING APPARATUS WITH CASSETTE-TYPE CLEANER

BACKGROUND OF THE INVENTION

1. Field of the Invention

The present invention relates to an image forming apparatus, and more particularly, to an image forming apparatus having a cassette-type cleaner for removing contaminant sticking to the surface of a photosensitive medium or a transfer roller.

2. Description of the Related Art

In general, an image forming apparatus applied to a laser printer or the like forms a latent electrostatic image on a photosensitive medium such as a photoreceptor drum or a photoreceptor belt, and the latent electrostatic image is developed using a toner having a predetermined color into a toner image and transferred to a sheet of paper, thereby printing a desired image.

The laser printer is largely divided into a wet type and a dry type according to the toners used. The liquid laser printer employs a developer liquid having a toner mixed with a volatile liquid carrier. The liquid laser printer using such a developer liquid has a better printing quality than the dry laser printer using a powdered toner, and can be protected from harmful toner powder. Thus, this type of developer liquid is increasingly used.

Referring to FIG. 1, the conventional liquid image forming apparatus includes a photoreceptor belt 110 on an endless track, a first transfer roller 121, a second transfer roller 122 and a third transfer roller 123, for circulating the photoreceptor belt 110 in a given path.

Also, there is provided a main charger 135 installed in one side of the photoreceptor belt 110 for charging the surface of photoreceptor belt 110 into uniform charges. In the lower portion of the photoreceptor belt 110, there are provided a laser scanning unit (LSU) 130 for scanning a laser beam onto the photoreceptor belt 110 according to an image signal and forming a latent electrostatic image, and a development device 140 for developing the latent electrostatic image into a toner image by applying a developer liquid composed of a toner having a predetermined color, to a region where the latent electrostatic image is formed. Particularly, in the case of a color printer, there are provided a plurality of laser scanning units (LSUs) 130 for color image implementation and a plurality of development devices each containing a developer liquid having a predetermined color. After the development device 140 develops the toner image, the developer liquid sticking to the photoreceptor belt 110 is dried by a drying roller 151 and a heating roller 152 so that the liquid carrier is removed. Thus, only the toner image developed by the toner, remains on the latent electrostatic image.

The toner image is transferred to a sheet 126 by a transfer roller 124 installed in parallel with the first roller 121 having the photoreceptor belt 110 interposed therebetween. The sheet 126 is fed between the transfer roller 124 and a pressing roller 125 installed in parallel with the transfer roller 124. As described above, the toner image transferred to the sheet 126 is fixed by a separate fixation means (not shown), thereby finally obtaining a desired image.

During the transfer procedure, after the toner image is transferred to the sheet 126, the toner remains on the photoreceptor belt 110. The residual toner may deteriorate printing quality in repetitive printing procedures, thereby resulting in contamination of the system. To remove the residual toner, conventionally, a cleaning roller 160 for cleaning the photoreceptor belt 110 is installed between the transfer roller 124 and the main charger 135 in order to either contact or not contact the surface of the photoreceptor belt 110.

The size of the surface area of the cleaning roller 160 in contact with the surface of the photoreceptor belt 110 is closely related with the contaminant removing efficiency and the life of the cleaning roller 160. Thus, in order to increase the surface area of the cleaning roller 160 in contact with the photoreceptor belt 110, it is preferable to increase the size of the cleaning roller 160 as much as possible. However, increasing the size of the cleaning roller 160 is restricted by the given space of the image forming apparatus. Moreover, a relatively small cleaning roller has a shorter life, and thus, contamination of the photoreceptor belt or an image forming apparatus contiguous to the photoreceptor belt cannot be prevented effectively.

SUMMARY OF THE INVENTION

To solve the above problems, it is an objective of the present invention to provide an image forming apparatus having an improved cleaning means which can effectively suppress contamination of moving members including a photoreceptor belt.

Accordingly, to achieve the above objective, there is provided an image forming apparatus including:

- a photoreceptor belt circulating along an endless track by a plurality of rollers;
- at least one laser scanning unit for forming a latent electrostatic image on the photoreceptor belt;
- at least one development unit for developing the latent electrostatic image formed on the photoreceptor belt into a toner image;
- a drying unit for drying the photoreceptor belt;
- a transfer unit for transferring the toner image of the photoreceptor belt onto a sheet of paper; and
- at least one cassette-type cleaning means having a case having a cavity at its one side, a cleaning belt partially exposed by the cavity and installed within the case in contact with the contaminated portion of the image forming apparatus, and first and second guiding rollers rotatably installed within the case and a predetermined distance spaced apart from each other, for guiding the cleaning belt.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
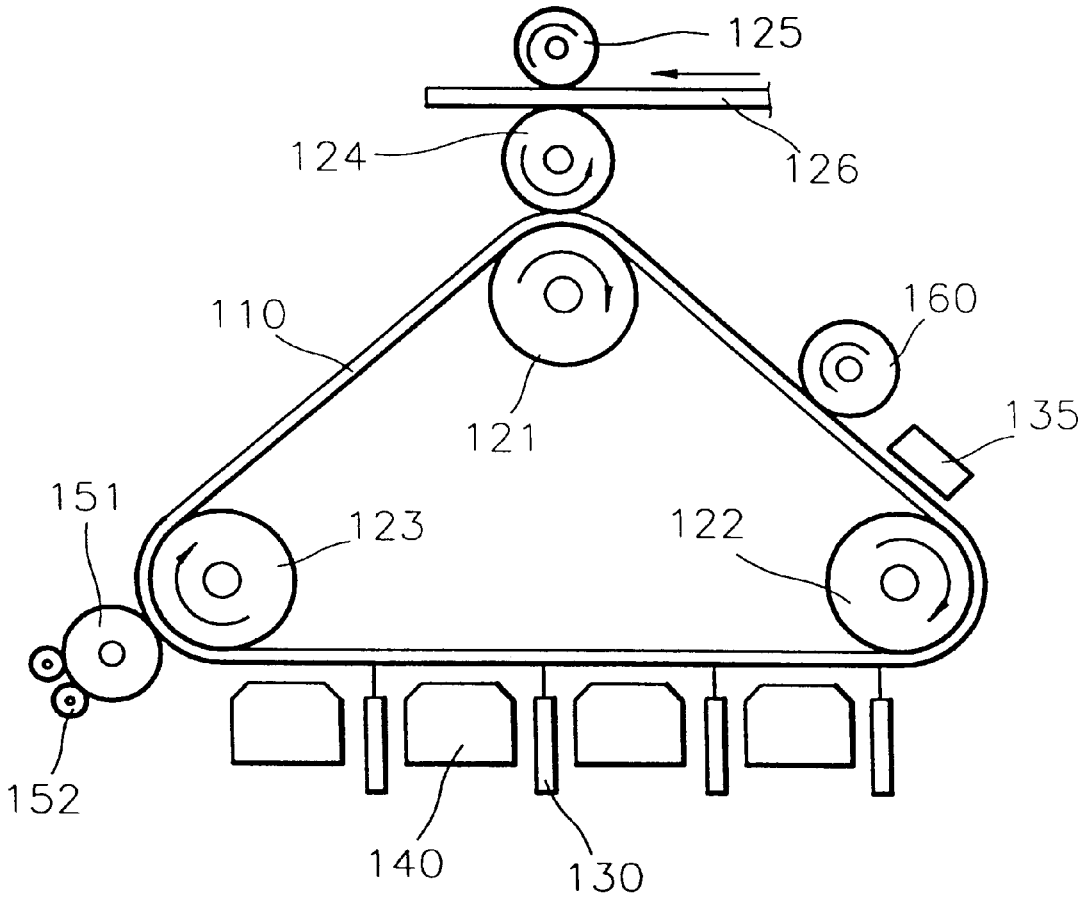
FIG. 1 is a schematic diagram illustrating important parts of a conventional image forming apparatus.
Figure 2:
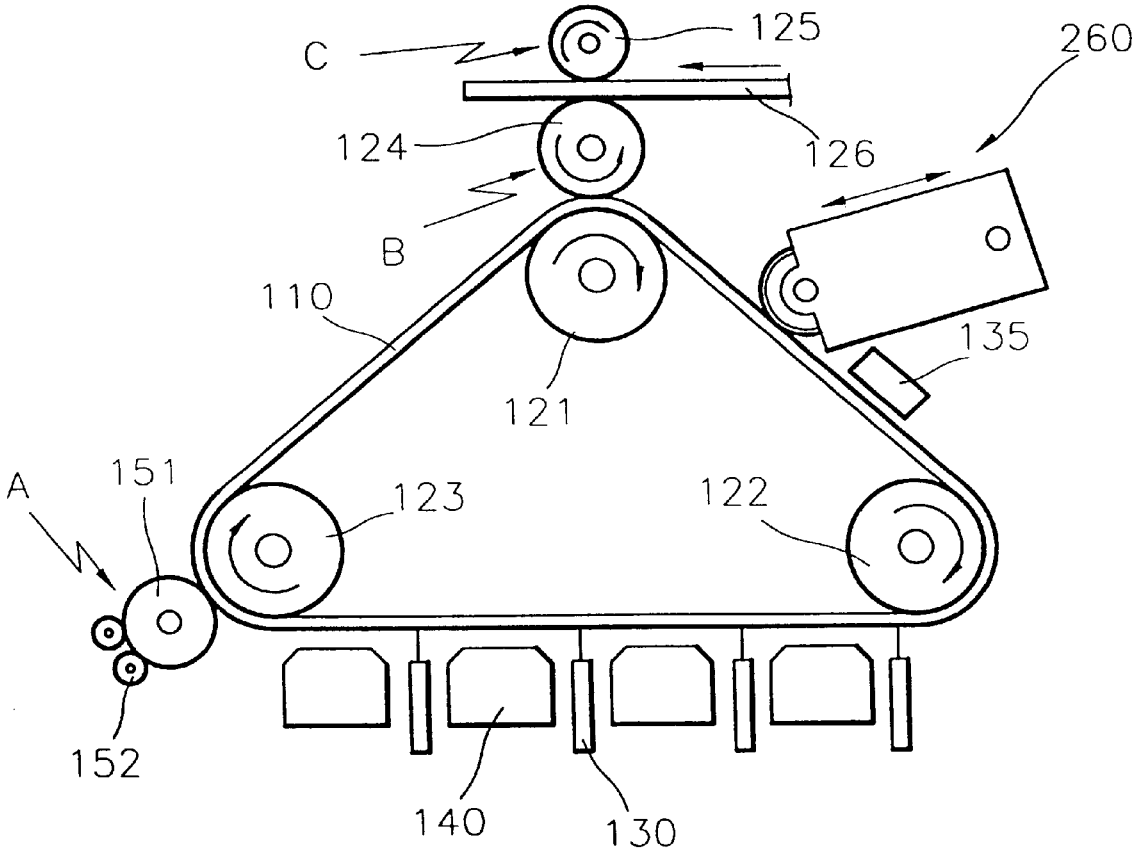
FIG. 2 is a schematic diagram illustrating the internal structure of an image forming apparatus having a cassette-type cleaner according to a preferred embodiment of the present invention.

FIG. 2 is a schematic diagram illustrating the internal structure of an image forming apparatus having a cassette-type cleaner according to the present invention, in which the same reference numerals denote the same elements shown in FIG. 1.

Referring to FIG. 2, as a photosensitive medium on which a latent electrostatic image is formed, a photoreceptor belt 110 is supported by first, second and third rollers 121, 122 and 123. The third roller 123 is a driving roller rotated by a driving motor (not shown) for rotating the photoreceptor belt 110, and the second roller 122 is a steering roller for preventing meandering by adjusting the torsion force applied to the photoreceptor belt 110.

A charger 135 for charging the photoreceptor belt 110 is provided in the movement block of the photoreceptor belt 110 between the first and second rollers 121 and 122. In the lower portion of the photoreceptor belt 110 between the second and third rollers 122 and 123, there are alternately provided a plurality of laser scanning units (LSUs) 130 for scanning a laser beam onto the photoreceptor belt 110 according to an image signal and forming a latent electrostatic image, and a plurality of development devices 140 for developing the latent electrostatic image into a toner image by applying a developer liquid to a region where the latent electrostatic image is formed. The toner image formed by the development devices 140 is dried while passing through a drying roller 151 and a heating roller 152. The toner image is transferred to the surface of a transfer roller 124 installed in parallel with the first roller 121. The toner image transferred to the surface of the transfer roller 124 is transferred to a sheet 126. The sheet 126 is fed between the transfer roller 124 and a pressing roller 125 under a constant pressure.

Even after the toner image of the photoreceptor belt 110 is transferred to the sheet 126 during the transfer procedure, a trivial amount of the toner remains on the photoreceptor belt 110. The residual toner is removed by a cassette-type cleaner 260 to be described later, which is the main feature of the present invention.

The cassette-type cleaner 260 is installed to contact the surface of the photoreceptor belt 110 between the transfer roller 124 and the charger 135. The cassette-type cleaner 260 can be optionally installed on members contacting the developer liquid or toner image, such as the drying roller 151, the transfer roller 124 or the pressing roller 125, which may be contaminated, in addition to the photoreceptor belt 110.

In FIG. 2, reference characters A, B and C represent the above parts at which the cassette-type cleaner 260 may be optionally installed.

Figure 3:
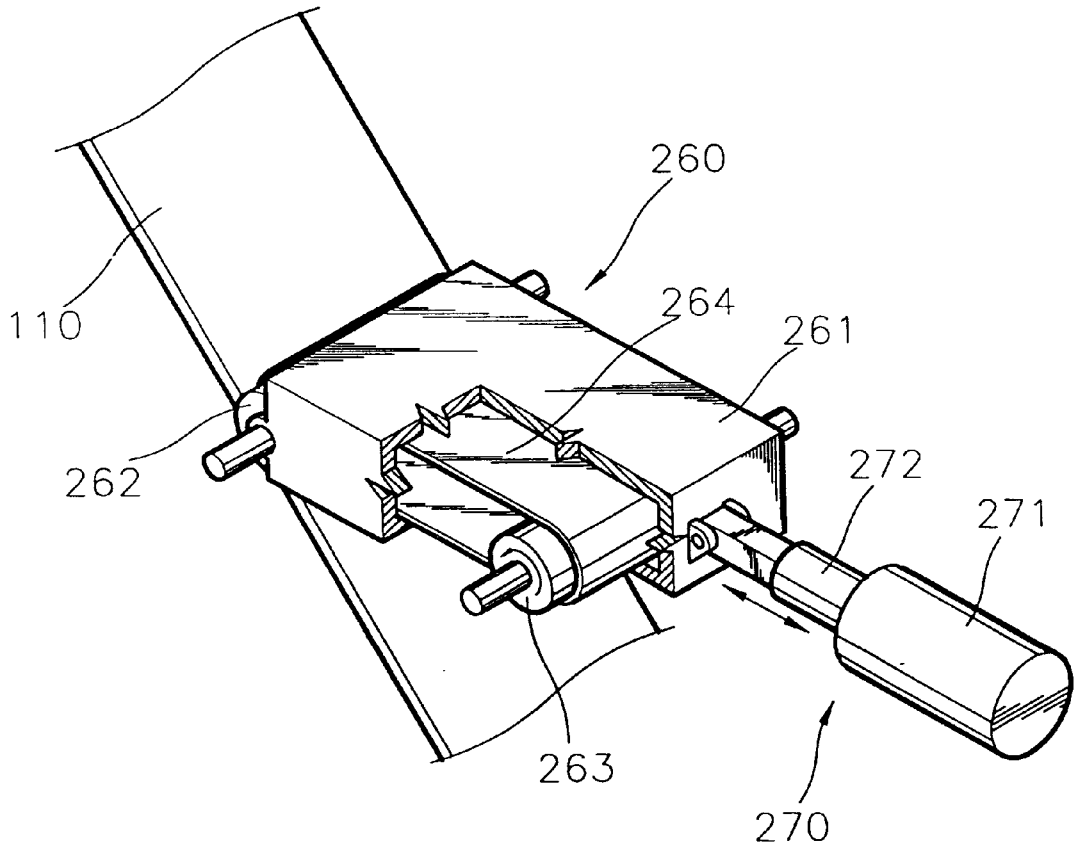
FIG. 3 is a perspective view of the cassette-type cleaner shown in FIG. 2.

Referring to FIG. 3 which is a perspective view of the cassette-type cleaner 260, the cassette-type cleaner 260 includes a case 261, a first guiding roller 262, and a second guiding roller 263 and a cleaning belt 264. The cleaning belt 264 can be made of an adhesive tape or fabric. In the case when the cleaning belt 264 is made of fabric, the fabric is not necessarily adhesive. At one side of the case 261, there is provided a cavity, through which the cleaning belt 264 contacts the contaminated portion of the photoreceptor belt 110. The first and second guiding rollers 262 and 263 are spaced a predetermined distance apart from each other and guide the circulation of the cleaning belt 264.

Since the cleaning belt 264 is guided by the first and second guiding roller 262 and 263 and the surface of the photoreceptor belt 110, and is exposed by the cavity of the case 261, the cleaning belt 264 contacts the circulating photoreceptor belt 110, and rotates accordingly. The cleaning belt 264 circulating in contact with the photoreceptor belt 110 removes foreign matter such as excess toner remaining on the photoreceptor belt 110.

Since the cassette-type cleaner 260 using a band-like cleaning belt has a wider surface area than the conventional cleaning roller, its cleaning efficiency is improved and its life is elongated. When the cleaning belt 264 is deteriorated too much to be used further, only the cleaning belt 264 installed in the cassette-type cleaner 260 need be replaced.

Preferably, the cassette-type cleaner 260 is installed to be capable of being either in contact with or not in contact with the photoreceptor belt 110. In other words, only when cleaning is necessary, is the cleaning belt 264 of the cassette-type cleaner 260 contacted with the surface of the photoreceptor belt 110; thereby being more economical.

To this end, a shifter 270 for making the cleaning belt 264 of the cassette-type cleaner 260 contact or not contact the contaminated portion of the photoreceptor belt 110, is connected to the cassette-type cleaner 260. The shifter 270 includes an actuator 271 for generating a mechanical reciprocation force using working fluid such as a pneumatic or oil-hydraulic cylinder, and an actuating load 272 connecting the actuator 271 to one side of the case 261 and reciprocating it by using the actuator 271.

Figure 4:
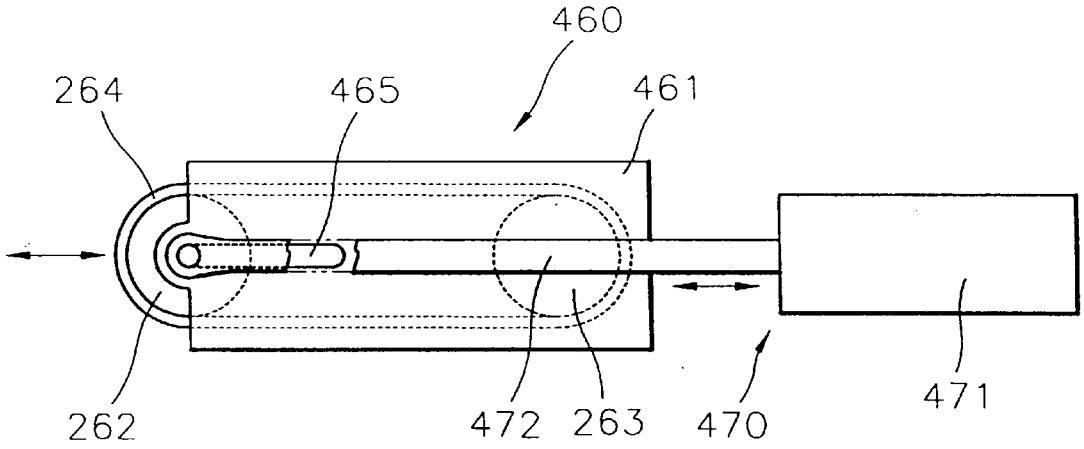
FIG. 4 is a side view of the cassette-type cleaner shown in FIG. 2 according to another embodiment of the present invention.

Referring to FIG. 4 which illustrates a cassette-type cleaner 460, a guiding groove 465 guided by the rotation shaft of the first guiding roller 262 is formed at both sides of a case 461. A shifter 470 includes an actuator 471, and an actuating load 472 reciprocating by the actuator 471. The actuating load 471 is connected to the shaft of the first guiding roller 262. Thus, the first guiding roller 262 is moved along the guiding groove 465 by the reciprocation of the actuating load 472 by the actuator 471 so that the cleaning belt 264 either contacts or does not contact the surface of the photoreceptor belt 110. Therefore, unlike the above-described embodiment, in bringing the cleaning belt 264 into contact with the photoreceptor belt 110 or separating the cleaning belt 264 from the photoreceptor belt 110, it is not necessary to move the whole cassette-type cleaner 460.

Figure 5:
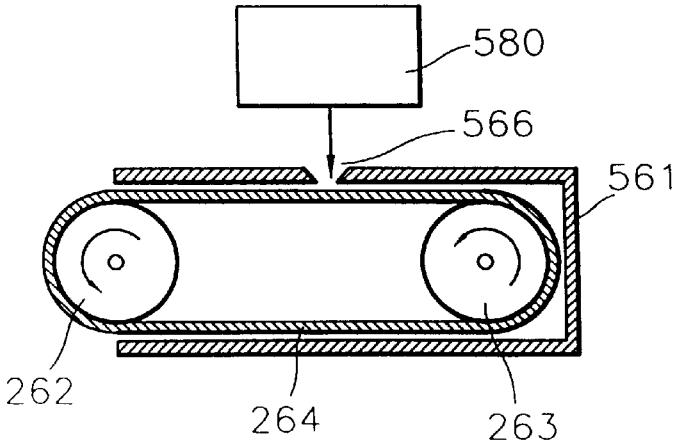
FIG. 5 is a cross-sectional view of a cassette-type cleaner having a cleaning liquid supplier.

As shown in FIG. 5, in the case where the cleaning belt 264 is made of fabric, to enhance the contaminant removing efficiency, it is preferred that a cleaning liquid supplier 580 for supplying a cleaning liquid such as acetone to the cleaning belt 264 is separately provided. The cleaning liquid is supplied from the cleaning liquid supplier 580 to the cleaning belt 264 through a cleaning liquid supply inlet 566 formed on a case 561. Supplying the cleaning liquid enhances the photoreceptor cleaning efficiency of the cleaning belt 264.

As described above, according to the present invention, the efficiency of removing contaminants sticking to the surface of a photoreceptor belt is increased by using a cassette-type cleaner employing a band-like cleaning belt, and the life of the cleaner is lengthened. Also, when the cleaner deteriorates, the cleaner can be used again by replacing only the cleaning belt.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. An image forming apparatus comprising:

a photoreceptor belt circulating along an endless track by a plurality of rollers;

a laser scanning unit for forming a latent electrostatic image on the photoreceptor belt;

a development unit for developing the latent electrostatic image formed on the photoreceptor belt into a toner image;

a drying unit for drying the photoreceptor belt;

a transfer unit for transferring the toner image of the photoreceptor belt onto a sheet of paper;

a cassette-type cleaner having a case having a cavity at its one side, a cleaning belt partially exposed by the cavity and installed within the case so as to contact a contaminated portion of the photoreceptor belt, and first and second guiding rollers rotatably installed within the case and spaced a predetermined distance apart from each other, for guiding the cleaning belt; and a shifter for making the cleaning belt of the cassette-type cleaner either contact or not contact the contaminated portion, wherein the shifter includes an actuator, and an actuating load connecting the actuator to a shaft of the first guiding roller installed in the cavity of the case and being reciprocated by the actuator, and wherein a guiding groove for guiding the shaft of the first guiding roller to move is formed at both sides of the case so that the first guiding roller moves along the guiding groove by the reciprocating actuating load so as that the cleaning belt either contacts or does not contact the contaminated portion.

2. The image forming apparatus according to claim 1, wherein the cleaning belt formed of an adhesive tape.

3. The image forming apparatus according to claim 1, wherein the cleaning belt is formed of fabric and said image forming apparatus further includes a cleaning liquid supplier for supplying a cleaning liquid to the fabric.

4. The image forming apparatus according to claim 1, wherein said photoreceptor belt circulates clockwise, whereas said cleaning belt circulates counterclockwise.

5. The image forming apparatus according to claim 1, wherein said photoreceptor belt circulates counterclockwise, whereas said cleaning belt circulates clockwise.

* * * * *